US011491449B2

(12) United States Patent
Teuber et al.

(10) Patent No.: US 11,491,449 B2
(45) Date of Patent: Nov. 8, 2022

(54) DEVICE FOR GENERATING GAS BUBBLES IN SUSPENSIONS FOR THE ENRICHMENT OF MINERAL AND NON-MINERAL RAW MATERIALS AND USE OF SUCH A DEVICE

(71) Applicant: TAKRAF GMBH, Leipzig (DE)

(72) Inventors: Heiko Teuber, Leipzig (DE); Venkoba Rao Bidarahalli, Bangalore (IN); Mohan Kumar Katuga Siddoji Rao, Bangalore (IN)

(73) Assignee: TAKRAF GMBH, Leipzig (DE)

( * ) Notice: Subject to any disclaimer, the term of this patent is extended or adjusted under 35 U.S.C. 154(b) by 115 days.

(21) Appl. No.: 17/056,287

(22) PCT Filed: Apr. 12, 2019

(86) PCT No.: PCT/EP2019/059437
§ 371 (c)(1),
(2) Date: Nov. 17, 2020

(87) PCT Pub. No.: WO2019/206678
PCT Pub. Date: Oct. 31, 2019

(65) Prior Publication Data

US 2021/0205769 A1 Jul. 8, 2021

(30) Foreign Application Priority Data

Apr. 25, 2018 (DE) ..... 10 2018 109 952.5

(51) Int. Cl.
*B01F 7/00* (2006.01)
*B01F 7/16* (2006.01)
(Continued)

(52) U.S. Cl.
CPC ..... *B01F 27/2722* (2022.01); *B01F 23/2331* (2022.01); *B01F 23/23342* (2022.01);
(Continued)

(58) Field of Classification Search
CPC .... B01F 27/27; B01F 27/2722; B03D 1/1412; B03D 1/22
See application file for complete search history.

(56) References Cited

U.S. PATENT DOCUMENTS 3,479,017 A * 11/1969 Thikotter ..... C02F 3/16 210/219
4,283,357 A 8/1981 Sidery
(Continued)

FOREIGN PATENT DOCUMENTS

CN 202490592 U 10/2012
EP 0287251 B1 7/1993
(Continued)

OTHER PUBLICATIONS

International Search Report and Written Opinion of the International Searching Authority for International Application No. PCT/EP2019/059437, dated Jul. 31, 2019.
(Continued)

*Primary Examiner* — Elizabeth Insler
(74) *Attorney, Agent, or Firm* — Heslin Rothenberg Farley & Mesiti P.C.

(57) ABSTRACT

The invention relates to a device for generating gas bubbles in suspensions, which are contained in a tank, having a rotation-symmetric stator (16) and a rotation-symmetric rotor (15), which is connected to a hollow drive shaft (5), wherein the stator, the rotor and the hollow drive shaft are arranged concentrically about a vertical axis of rotation (17) of the rotor and the drive shaft, and the rotor executes a rotational movement about the axis of rotation inside the stator.

18 Claims, 8 Drawing Sheets

(51) Int. Cl.

| | |
|---|---|
| ***B01F 3/04*** | (2006.01) |
| ***B03D 1/22*** | (2006.01) |
| ***B01F 27/272*** | (2022.01) |
| ***B01F 23/233*** | (2022.01) |
| ***B01F 27/053*** | (2022.01) |
| ***B01F 27/81*** | (2022.01) |

(52) U.S. Cl.
CPC ..... *B01F 27/0531* (2022.01); *B01F 27/812* (2022.01); *B03D 1/22* (2013.01); *B01F 23/23311* (2022.01); *B01F 23/233641* (2022.01); *B01F 2215/0422* (2013.01)

(56) References Cited

U.S. PATENT DOCUMENTS

| | | | | |
|---|---|---|---|---|
| 4,425,232 | A | 1/1984 | Lawrence et al. | |
| 4,551,285 | A | 11/1985 | Jackson | |
| 4,800,017 | A * | 1/1989 | Krishnaswamy .... | B03D 1/1493 210/219 |
| 6,000,840 | A | 12/1999 | Paterson | |
| 6,772,885 | B2 | 8/2004 | Bourke | |
| 6,805,243 | B1 | 10/2004 | Kallioinen et al. | |
| 9,266,121 | B2 | 2/2016 | Yoon et al. | |
| 2015/0251192 | A1 | 9/2015 | Caldwell et al. | |

FOREIGN PATENT DOCUMENTS

| | | | |
|---|---|---|---|
| RU | 2162372 | C1 | 1/2001 |
| RU | 109237 | U1 | 10/2011 |
| WO | 2015/059360 | A1 | 4/2015 |

OTHER PUBLICATIONS

International Preliminary Report on Patentability for International Application No. PCT/EP2019/059437, dated Oct. 27, 2020.

* cited by examiner

Fig. 4 A-A

DEVICE FOR GENERATING GAS BUBBLES IN SUSPENSIONS FOR THE ENRICHMENT OF MINERAL AND NON-MINERAL RAW MATERIALS AND USE OF SUCH A DEVICE

CROSS REFERENCE TO RELATED APPLICATIONS

This application is a national stage filing under section 371 of International Application No. PCT/EP2019/059437, filed on Apr. 12, 2019, and published on Oct. 31, 2019 as WO 2019/206678, which claims priority to German Application No. 10 2018 109 952.5, filed on Apr. 25, 2018. The entire contents of WO 2019/206678 are hereby incorporated herein by reference.

The invention relates to a device for generating gas bubbles in suspensions for the enrichment of mineral and non-mineral raw materials and the use of such a device. For the purposes of this application, suspensions are mixtures of liquids and raw materials, in particular mineral resources, such as copper, tin, platinum group metals (iridium, rhodium or palladium), phosphates and slag in a finely ground phase, which are contained in tanks of flotation cells. For the purpose of separating desired raw materials from this suspension, said suspension is mixed and swirled with air within the tanks, so that a gas bubble-air mixture is formed. As a result, three zones are formed within the suspension. In the lower third of the tank, the swirling of the suspension and, as a result, the generation of bubbles takes place. In the overlying third of the tank, the so-called calming zone, the bubbles with the adhering hydrophobic raw material particles drive towards the surface of the suspension and deposit in the upper third of the tank as foam. This foam leaves the tank of the flotation cell at its top by an overflow and is available for further processing by means, which are known per se.

In order to generate the swirling of the suspension within the tank, a rotor executes a rotational movement with a speed to be defined within a surrounding stator. As a result of this rotational movement, the suspension is sucked through the gap between the stator and the support device and returned to the surrounding area of the suspension through the casing of the stator. In this case, a portion of the suspension containing hydrophilic raw materials sinks back to the bottom of the tank and is dug from there.

By simultaneously introducing air into the suspension, the suspension is enriched with gas bubbles. As a result of the swirling of this gas bubble suspension mixture, a force acts on the gas bubbles and these break down further into smaller and smaller bubbles.

Category-specific devices for generating gas bubbles are well known from the prior art.

The document U.S. Pat. No. 4,283,357 A describes a rotor-stator mechanism in which the air distributor, which is located in the rotor, directs the air against the stator vanes using tangentially arranged air guidance channels. In this case, the air guidance channels form an angle between 20° and 60° relative to the radial.

The document 9266121 B2 discloses a rotor with vanes, which extend vertically and are arranged radially to the axis of rotation and which are provided with curved vane exterior edges. The air flows through the channel extending inside the drive shaft and the rotor through the air intake openings and into the suspension. The air is directed to the air intake openings of the rotor through a network of inner air guidance channels located at the upper central portion of the rotor. Furthermore, the rotor is designed such that the suspension in the middle part of the rotor is sucked axially along the axis of rotation and is directed through corresponding outlet openings back into the surrounding suspension.

The document US 2015/0251192 A1 describes a stator with a plurality of vertically aligned baffles arranged around the rotor. The rotor is connected to a vertically aligned shaft. The vanes of the rotor extend vertically and are curved at their exterior edges. The baffles of the stator also extend vertically and are provided with a plurality of horizontally arranged slots for better shear effect. Furthermore, the air intake openings required for ventilation of the suspension are arranged so that the air is passed between the vanes of the rotor.

The document U.S. Pat. No. 4,425,232 A discloses a stator-rotor combination in which the inner sides of the stator baffles follow the contour of the exterior edges of the stator vanes and have the same distance.

Possible arrangements and embodiments of air outlet openings are described in the document U.S. Pat. No. 6,805,243 B1. In this case, flat, horizontal slots are a preferred embodiment. Furthermore, the position of the air outlet openings underneath the plate of the rotor is disclosed.

The document U.S. Pat. No. 4,551,285 A describes a rotor which is surrounded by vertically arranged baffles. The vanes of the rotor are radially arranged on a rod and extend from its exterior side to half of the radius. Furthermore, smaller vanes act as air intake vanes in the area of the drive shaft.

The document U.S. Pat. No. 6,772,885 B2 discloses an embodiment of the plate of a rotor, which has an angle of inclination between 5° and 70° in the direction of the bottom side of the rotor.

An embodiment of a stator-rotor arrangement for improving the pumping power of such arrangements is described by EP 0287251 B1. Due to the arrangement of the baffles in relation to the exterior edge of the rotor, precisely the gas bubbles located at the bottom of the tank of the suspension-filled flotation cell are lifted and split.

CN 2 02 490 592 U discloses a powder-liquid mixing device comprising a mixer having a powder inlet, a liquid inlet and a liquid outlet. The mixer comprises a stator and a rotor. The wall of the stator comprises a plurality of holes and the rotor has a claw-shaped metal sheet, which is attached to the rotor by means of screws. The rotor is driven by a motor wherein shear and centrifugal forces are generated to disperse and homogenize the powder in the liquid.

A disadvantage of all above-mentioned rotor-stator combinations is that these devices have a low efficiency in the extraction of raw materials with low-grade occurrence. Especially in this case it is necessary to extract such raw materials from a finely ground mineral phase, which requires the smallest possible gas bubbles with small size differences. Existing plants are able, by extending the residence time of the swirled suspension in the region of the rotor-stator combination, to generate small bubbles, which are suitable for the extraction of these raw materials. However, this leads to a deterioration in the efficiency of such flotation plants.

To overcome these disadvantages of the prior art, the object of the invention is to generate a flow in suspensions, which extends the residence time of the gas bubble suspension mixture in the region of the stator and at the same time sets the flow rates at such a high level that the plants maintain a high efficiency.

This object is achieved by a stator-rotor combination for generating gas bubbles in suspensions, which is disclosed by claim 1. Further developments according to the invention are disclosed in the dependent claims.

According to the invention, the rotation-symmetric rotor is connected to a hollow drive shaft, whose axis of rotation is arranged concentrically with respect to the central axis of a surrounding stator. The rotor is composed of a plate, which represents the upper side of the rotor and a plurality of vanes extending axially and parallel to the axis of rotation away from the plate. Furthermore, the rotor is provided beneath its plate with air intake openings, which allow air to enter the suspension via the hollow drive shaft, the air guidance channels and the air intake openings. Preferably, the rotor is designed as a welded component, an additively manufactured component or a moulded component. The axis of rotation of the rotor is normal to the surface of the suspension.

The stator is designed as a cylindrical hollow body, which encloses the rotor. In this ca, the rotor and stator are arranged to each other so that the stator projects beyond the rotor on its upper side. The lower end of the rotor projects beyond the bottom of the stator and is located at the level of the gap between the stator and a vortex breaker, which is connected to the bottom surface of a support device. The casing of the stator consists of a plurality of strip-shaped, radially oriented baffles, which thereby form a perforated, cage-like shell, which can be flowed through by the suspension.

The stator is positioned on a support device which ensures a defined distance between the stator and the bottom surface and which introduces the forces acting on the stator due to the flow resistance into the bottom of the tank of the flotation cell. On the bottom plate a vortex breaker, known per se, is positioned, which serves to swirl the flowing suspension and the use of which is well known.

According to the invention, the vanes of the rotor extend at different distances from the plate in the axial direction. In this case, the inner edges of the shorter vanes have a radial distance from the drive shaft. The baffles of the stator are inclined relative to the axis of rotation. In this case, a first partial quantity of the baffles has an angle $\alpha$ of 30° to 60° and a second partial quantity of the baffles have an angle $\alpha'$ of −30° to −60° and thus allow a continuous swirling and thus fragmentation of the bubbles within the suspension. In particular, the values of the angles $\alpha$ and $\alpha'$ are the same. The baffles are materially interconnected and thereby form the casing of the stator.

In a preferred embodiment of the rotor, the exterior contours of all the vanes taper in a convex-curved manner as the distance from the plate increases. A straight exterior edge of the rotor is used when the production costs should be as low as possible. A higher efficiency of the rotor can be achieved with a curved exterior contour of the vanes.

In a preferred embodiment, a first partial quantity of the rotor vanes has the same length as the overall height of the rotor. A second and third partial quantity is made shorter, wherein the vane lengths of this second and third partial quantity are the same length, or in a preferred embodiment, have different longitudinal extensions, in order to obtain a stronger mixing of the suspension gas bubble mixture.

Preferably, all the vanes of the rotor are connected with the drive shaft in a form-fitting or materially connected manner. In a particularly preferred embodiment of the rotor, the shorter vanes are radially spaced from the drive shaft. This radial distance r is between 30% and 70% of the radius R and leads to an improved air bubble distribution within the suspension.

In a particularly preferred form of the rotor, the inside edges of the shorter vanes are tapered or pointed to a point towards the axis of rotation. This has the advantage that the air entering the suspension is guided with a low resistance on these vanes along these vanes and thus contributes significantly to the high efficiency of flotation systems, which are provided with such a device.

In a further preferred embodiment, the lower edges of the shorter vanes are horizontally oriented or inclined. They form an angle $\gamma$ between 0° and 60°, relative to the horizontal, which has an advantageous effect on the swirling of the suspension.

In order to supply air to the suspension, the drive shaft of the rotor is made hollow. Thus, air can be blown through this drive shaft into the rotor. Within the rotor, this air is distributed via air guidance channels to the preferably radially arranged air intake openings. The air guidance channels are preferably aligned so that they direct the air towards the bottom of the tank of the flotation cell. Here, the air guidance channels are preferably oriented at an angle $\varepsilon$ between 20°-60°, relative to the axis of rotation.

In one embodiment of the invention, the inner and outer circumferential surfaces of the stator are formed in a straight line and spaced from each other. In an alternative embodiment of the stator, the exterior circumferential surface is convexly curved. The inner and exterior circumferential surface in this embodiment always have the same distance from each other and thus have a positive influence on the bubble distribution.

The stator is preferably a welded component or a molded component or an additively manufactured component having a plurality of integrally interconnected metal sheets. On the one hand, the metal sheets represent the total quantity of the baffles, on the other hand, the cover ring, the intermediate rings and the seal ring are formed as metal sheet and are integrally connected to the baffles. The total quantity of baffles is divided in a preferred embodiment evenly on two partial quantities of baffles. The baffles are enclosed by the cover ring and the seal ring and subdivided by the optional intermediate rings. In this way, it is possible to advantageously produce a stiff and firm stator, which, on the one hand, absorbs the loads due to the flow resistance, while on the other hand, it may quickly be replaced, since the stator is subject to wear. In a preferred embodiment, the stator is divisible for the purpose of disassembly and assembly. Preferably, this dividing plane is vertically aligned by vertically aligned metal sheets or is arranged horizontally by divisible intermediate rings. In this preferred embodiment, the vertical divider plates or divisible intermediate rings are releasably connected together. In a particularly preferred embodiment of the rotor, the vertically divided segments can additionally be divided horizontally in order to then remove or insert them through manholes located at the bottom of the tank of the flotation cell. Advantageously, it is possible to disassemble and assemble the stator without having to manipulate the rotor. The segments are designed such that they consist of a part of the baffles, which are enclosed in the vertical direction by the cover ring, the intermediate ring and the cover ring. In the circumferential direction of the stator, a segment is delimited by the vertically arranged baffles.

For the purpose of easy manufacture of the stator, the cover ring is aligned horizontally. However, it has proven to be useful to tilt the ring. The inclination is such that the inner edge of the cover ring is inclined toward the bottom. The particularly preferred inclination angle $\beta$ is 30° to 60°. By means of this particularly preferred embodiment, the flow resistances for the swirled suspension are reduced, so that a more uniform swirling in the region of the stator can be ensured. The foam which is formed can then be removed from the surface by means of pumps.

The abrasive effect of the suspension on the vanes of the rotor and on the baffles of the stator cause a strong wear of the metallic material. It therefore proves to be advantageous if these components are coated with a low-cost wearable layer of plastic. In an alternative embodiment, the regions of the vanes and baffles that are exposed to the flow of the suspension, are hardened by a local structural change. This reduces the wear of the components. In addition, eliminating the polyurethane coating provides a weight advantage and increases the efficiency of the plant.

According to the invention, such rotor-stator combinations are used within tanks of flotation cells and are positioned in the lower third of the tank.

In order to practice the invention, it is also expedient to combine the above-described designs, embodiments and features of the claims of the invention with each other in a suitable arrangement.

The invention will be described below with reference to several embodiments and is represented graphically in the accompanying figures. The coordinate system used in the figures illustrates the orientation of the device within the suspension. The plane formed by the axes x and y is parallel to the surface of the suspension. The axis z is aligned normal to this plane.

Figure 1:
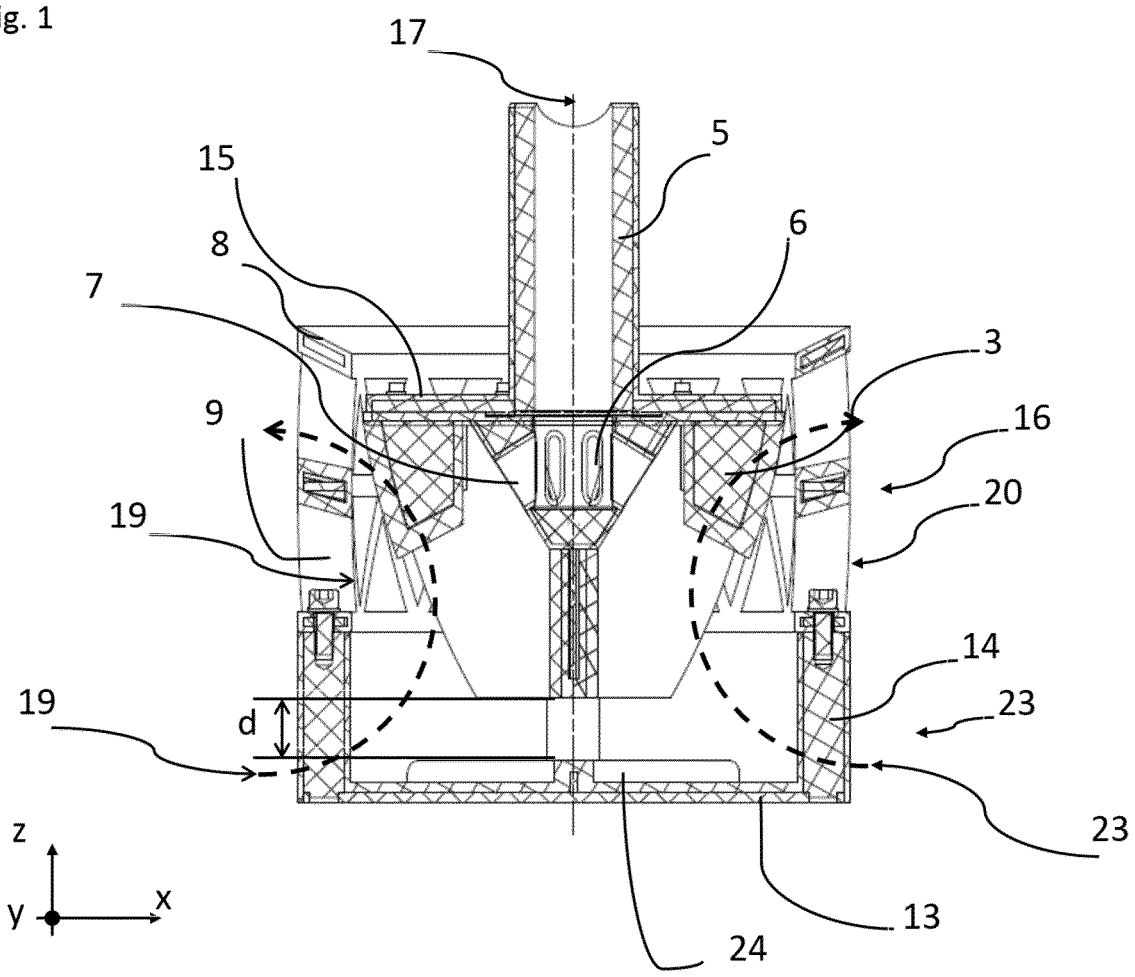
FIG. 1 shows a sectional view of a rotor-stator combination with a drive shaft, which is positioned on a support device. The elements required to drive the rotor and the surrounding tank of the flotation cell are not shown.
Figure 13:
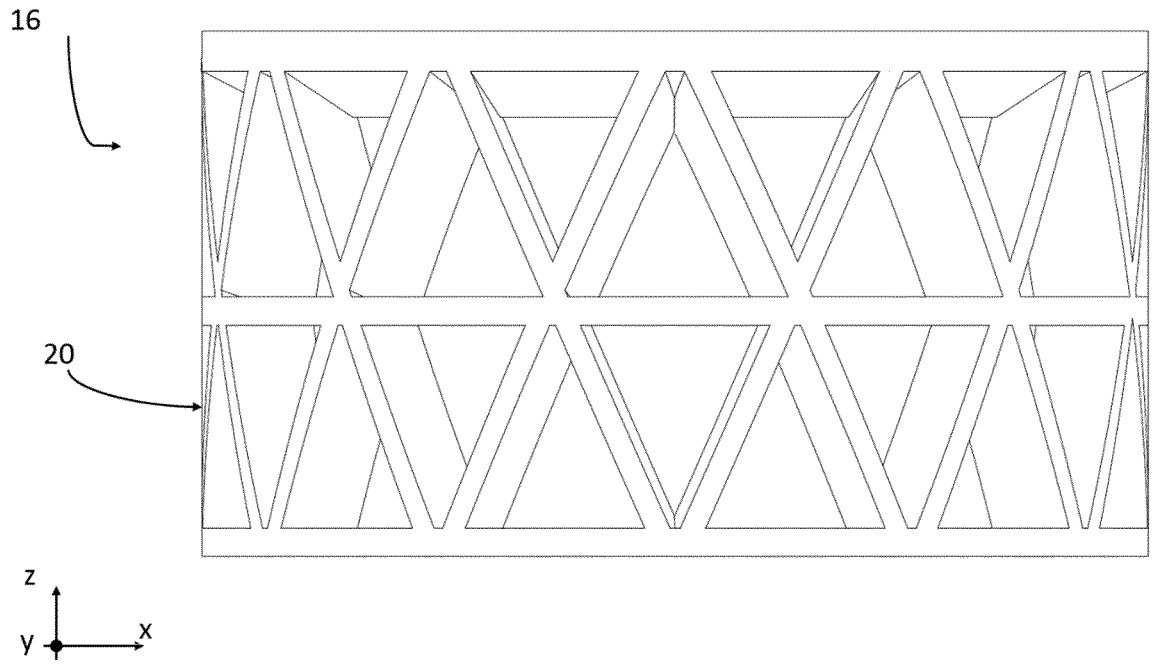

FIG. 13 shows a side view of an embodiment of the stator having linear circumferential surfaces A preferred embodiment of the device for generating gas bubbles is shown in FIG. 1 and consists essentially of a rotation-symmetric stator (16), which encloses a rotation-symmetric rotor (15) and is detachably connected to a support device (23). The stator is designed as a cylindrical hollow body and projects beyond the rotor (15) on its upper side. Furthermore, the rotor (15) projects beyond the stator (16) on its bottom side and is arranged at a distance d from the vortex breaker (24) positioned on the bottom (13) of the support device. The rotor (15) is connected to a hollow drive shaft (5) which is designed such that air can be introduced into the suspension through the air guidance channel (7) located inside the drive shaft (5) and via the air inlet openings (6). (29) indicates the flow direction of the suspension.

Figure 2:
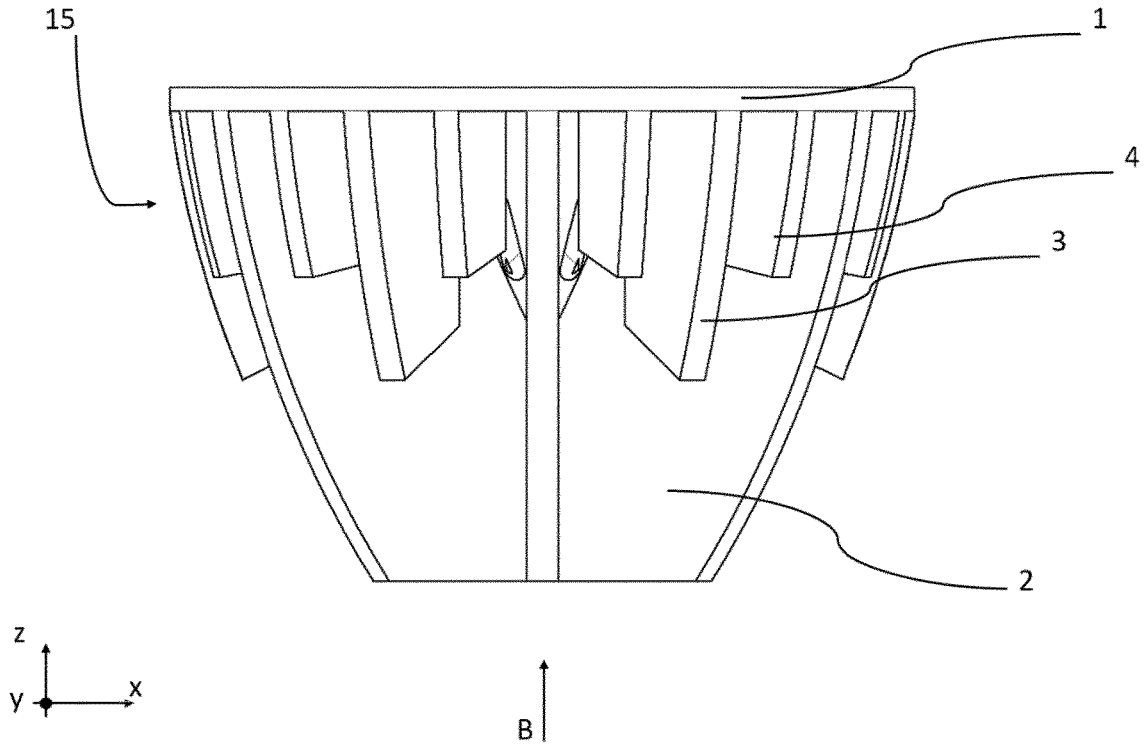
FIG. 2 shows a side view of a rotor. The drive shaft is not shown.

The embodiment of the rotor (15) shown in FIG. 2 is particularly suitable if the service life of such components is to be increased, since the gas bubbles in the suspension can be generated independently of the direction of rotation of the rotor (15). The rotor (15) has at its upper end a plate (1) from which vanes (2,3,4) with different lengths in the axial direction, extend radially to the axis of rotation (17). Here, the exterior edges of the vanes (2,3,4) taper with increasing distance from the plate continuously in a linear or convexly-curved manner. Furthermore, it is shown that the vanes (2, 3, 4) extend differently in the axial direction. A first part of the vanes (2) extends over the entire length of the rotor. A second (3) and a third (4) part of the vanes is shorter than the first part (2) of the vanes, wherein a part of the vanes (4) is in turn shorter than the other part (3) and thus a stronger swirling of the suspension gas bubble mixture is generated.

Figure 3:
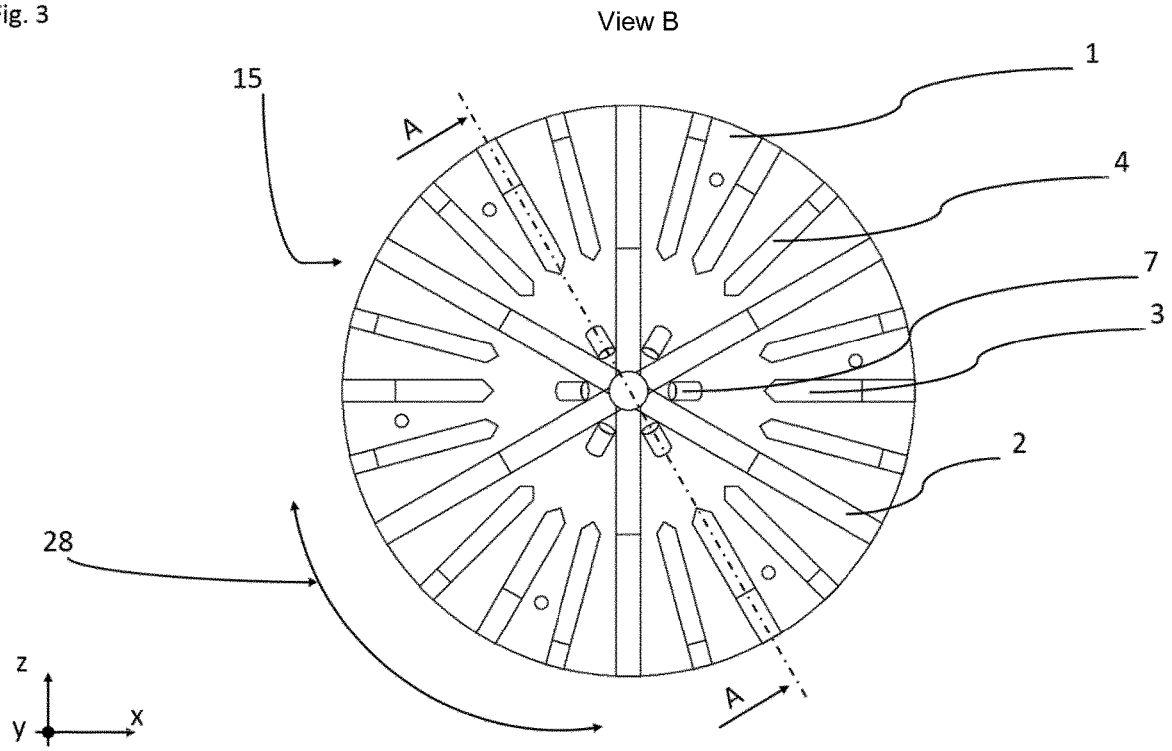
FIG. 3 illustrates the bottom side of the rotor of FIG. 2.

FIG. 3 shows the bottom side of a rotor (15) from the viewing direction B (see FIG. 2). Here it is shown that the vanes (2), which extend over the entire length of the rotor (15) are arranged in a cross shape around the axis of rotation (17) and are connected to the drive shaft. Furthermore, it is shown that the short vanes (3,4) are radially spaced from the drive shaft and that the inner edge (22) of these vanes (3,4) are sharp-edged and tapered in order to generate a large number of almost uniformly-distributed gas bubble diameters in the suspension.

Figure 4:
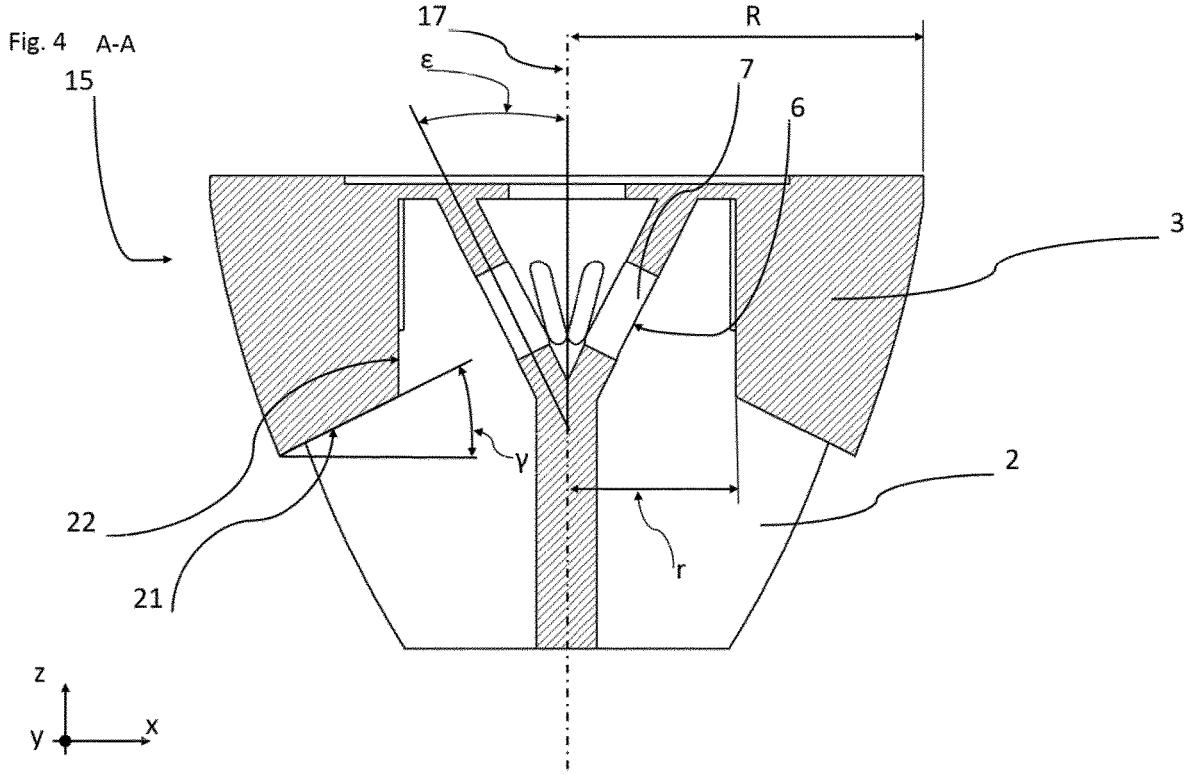
FIG. 4 shows a sectional view A-A of the geometric relationships of the vanes of the rotor of FIG. 3

FIG. 4 shows in a side view the sectional view corresponding to the section A-A (see FIG. 4). The lower edges (21) of the short vanes (3,4) are inclined in the direction of the plate, and cover an angle $\gamma$ of 23°. Furthermore, it is shown that the drive shaft (5) in the region of the short vanes (3,4) is formed so that the air guidance channels (7) deflect the air entering the suspension so that it impinges on the inner edges (22) of the short vanes (3, 4). The angle $\varepsilon$ is 26°.

Figure 5:
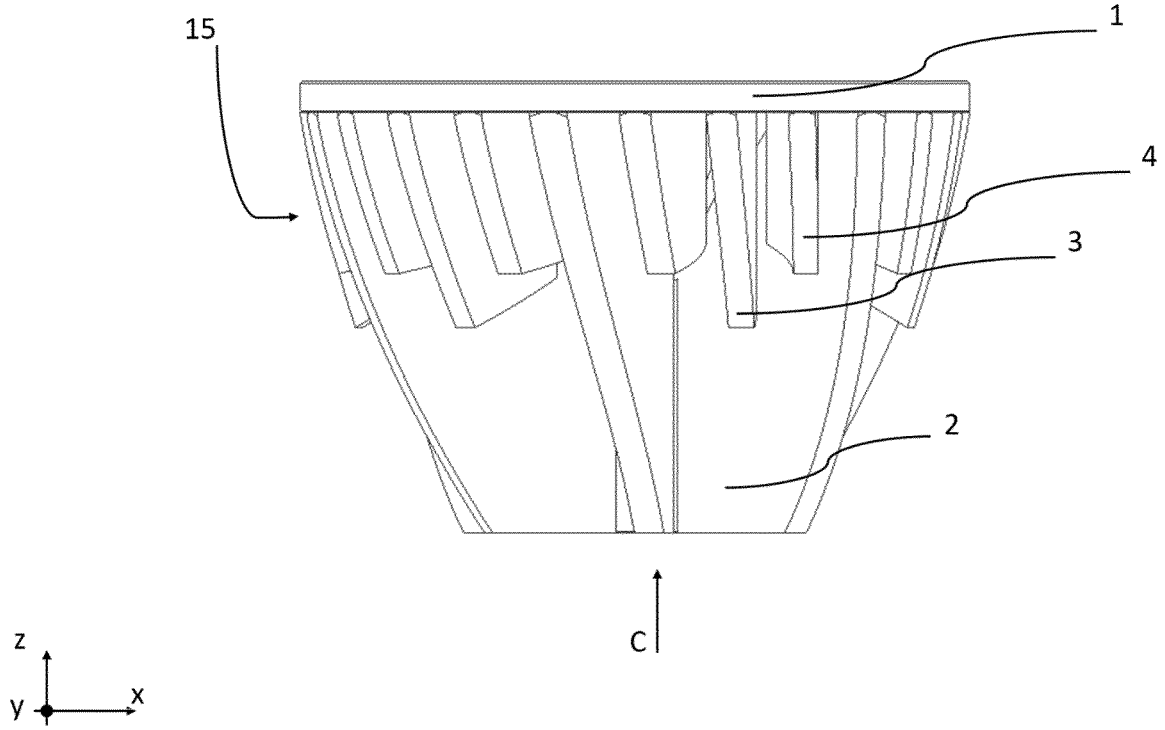
FIG. 5 shows an alternative embodiment of the rotor with curved vanes.

FIG. 5 shows in a side view an alternative embodiment of the rotor (15) provided for rotation with a preferred direction of rotation. Here, the vanes (2,3,4) extend with different lengths in the axial direction of the plate (1). With respect to the radial, the vanes (2,3,4) have a curved circular path.

Figure 6:
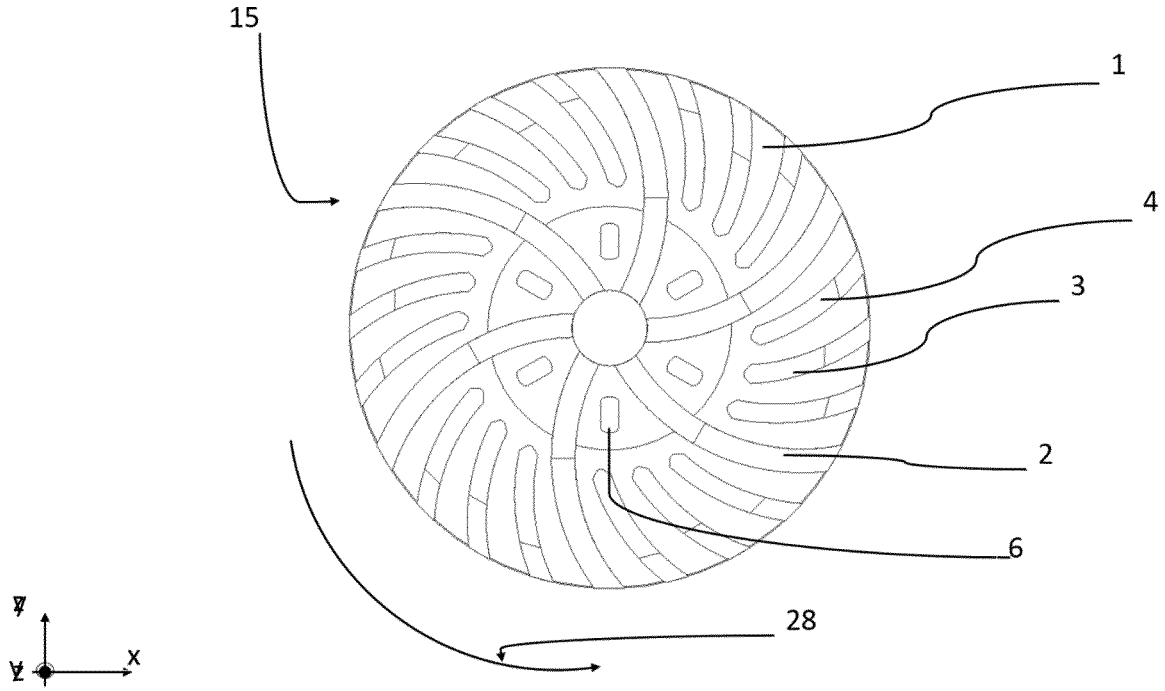
FIG. 6 illustrates the bottom side of the rotor of FIG. 5.

FIG. 6 shows the view of the bottom side, corresponding to the viewing direction C (see FIG. 5), of the alternative embodiment of the rotor (15) with curved vanes (2, 3, 4). Furthermore, the direction of rotation (28) for this embodiment of the stator is indicated.

Figure 7:
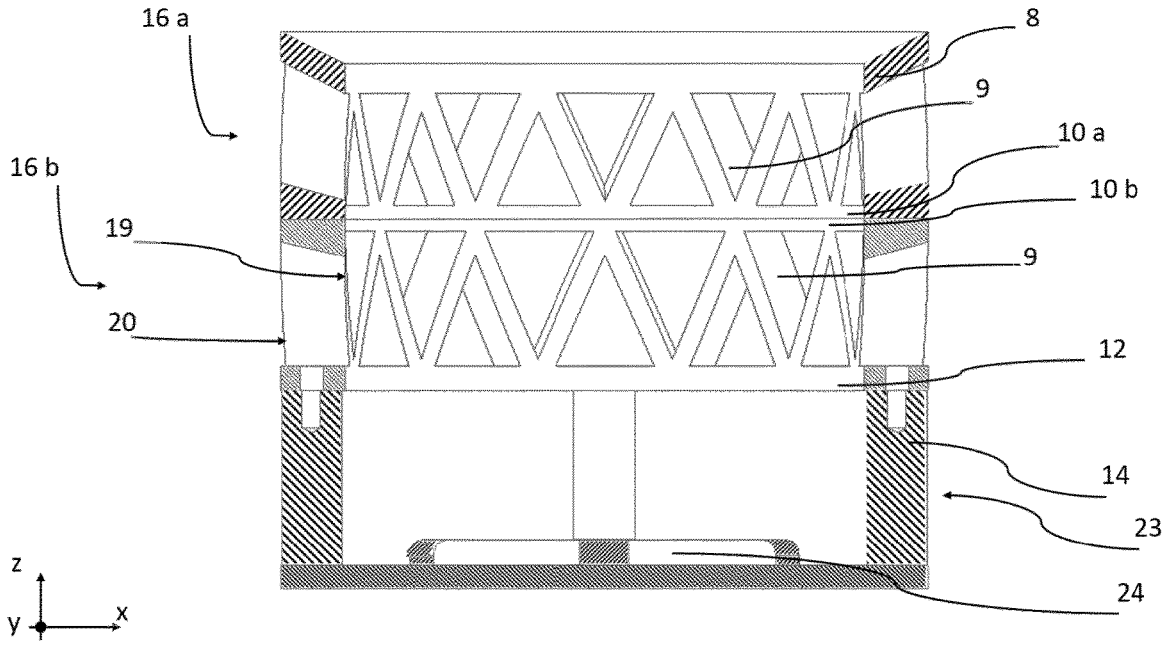
FIG. 7 shows the central sectional view of a two-part embodiment of the stator, which is positioned on a support device.

FIG. 7 shows a sectional view of the stator (16) of the device for generating gas bubbles, which is releasably connected to a support device (23). In this preferred embodiment, the stator (16) consists of an upper stator ring (16*a*), wherein the cover ring (8) and the divisible intermediate ring of the upper stator ring (10*a*) surround a partial quantity of the baffles (9). Accordingly, the intermediate ring of the lower stator ring (10*b*) and the seal ring (12) enclose a further partial quantity of the baffles (9). In the overall view of the stator, the exterior edges (20) of the baffles (9) have a convex contour. The inner edges (19) of the baffles (9) are concave and uniformly spaced from the exterior edges (20). The intermediate rings (10*a* and 10*b*) are detachably connected to each other. Furthermore, the seal ring (12) and the spacers (14) of the support device (23) are releasably connected to each other.

Figure 8:
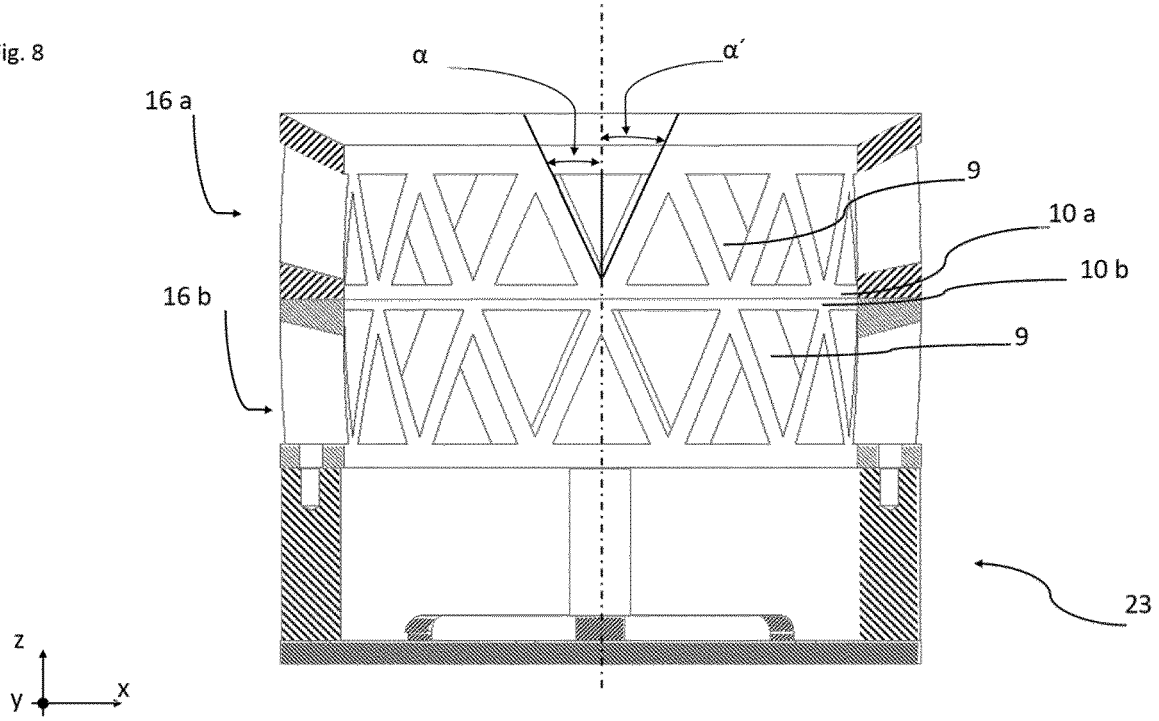
FIG. 8 shows a central sectional view of the stator of FIG. 7 and the geometric relationships of the baffles.

FIG. 8 shows a sectional view of the stator (16) of Fig. Here it is shown that a partial quantity of the baffles is arranged at an angle $\alpha$ of 25° and a second partial quantity of baffles (9) is arranged at an angle $\alpha'$ of −25°. Furthermore, it is shown that the baffles intersect in the region of the intermediate rings (10*a*, 10*b*), the seal ring (12) and the cover ring (8).

Figure 9:
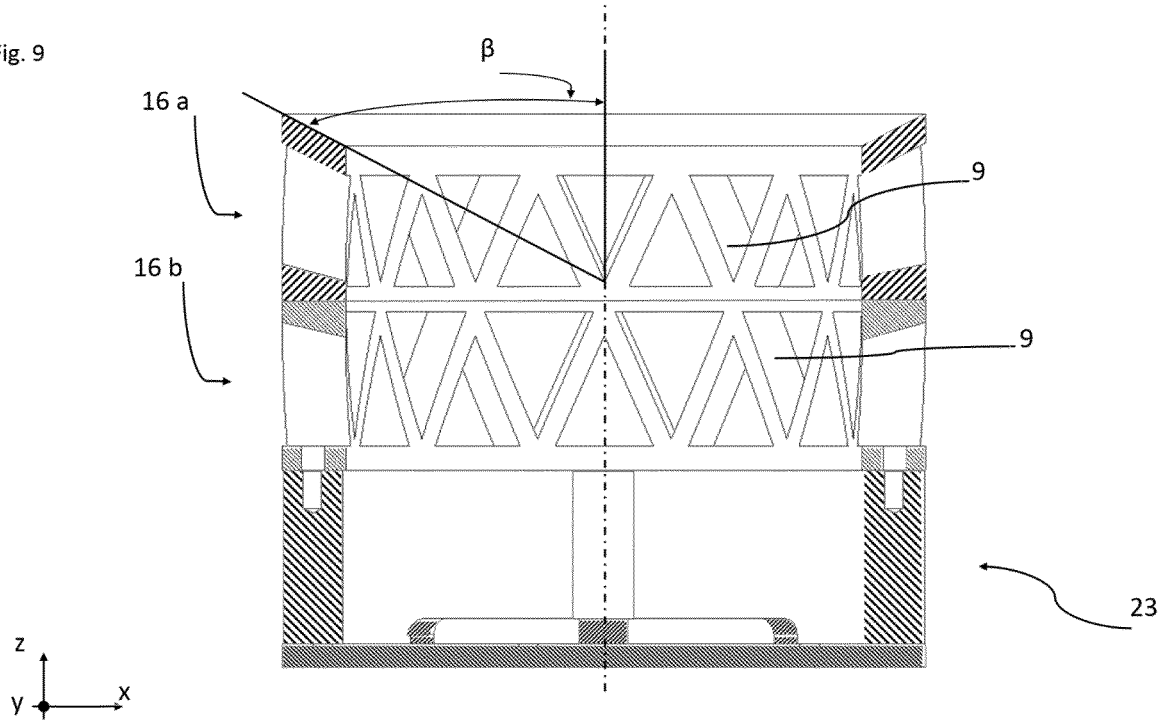
FIG. 9 shows a central sectional view of the stator of FIG. 7 and the geometric relationships of the upper cover ring.

In FIG. 9, a preferred embodiment of the stator (16) is shown. It is shown that the upper cover ring (8) is inclined in the direction of the support device (23) and thereby forms an angle β of 62°.

Figure 10:
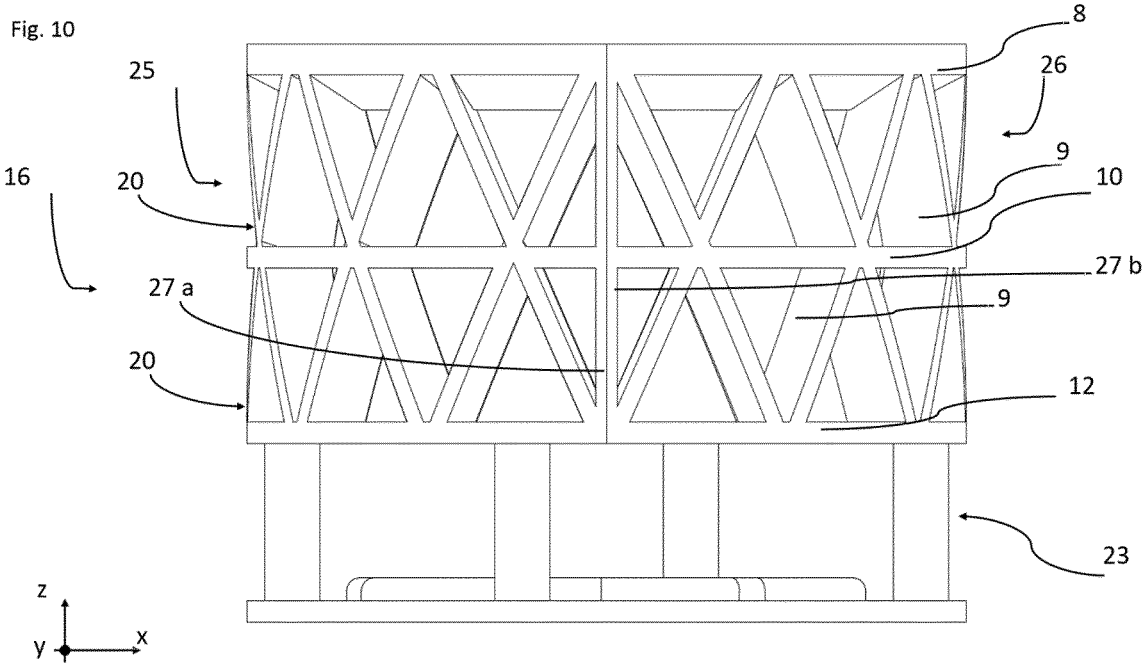
FIG. 10 shows a side view of a vertically divisible stator. In this case, the detachable connection of the segments is not shown.

In FIG. 10 an exemplary embodiment of a vertically divisible stator (16) is shown in a side view. The vertically extending dividing plane divides the stator into a part (25) and a part (26) which are detachably connected to one another in the region of the vertically extending, divisible guide plates (27*a, b*). Furthermore, it is shown that the exterior circumferential surface (20) of the stator (16) tapers towards the intermediate ring (10) and is convex.

Figure 11:
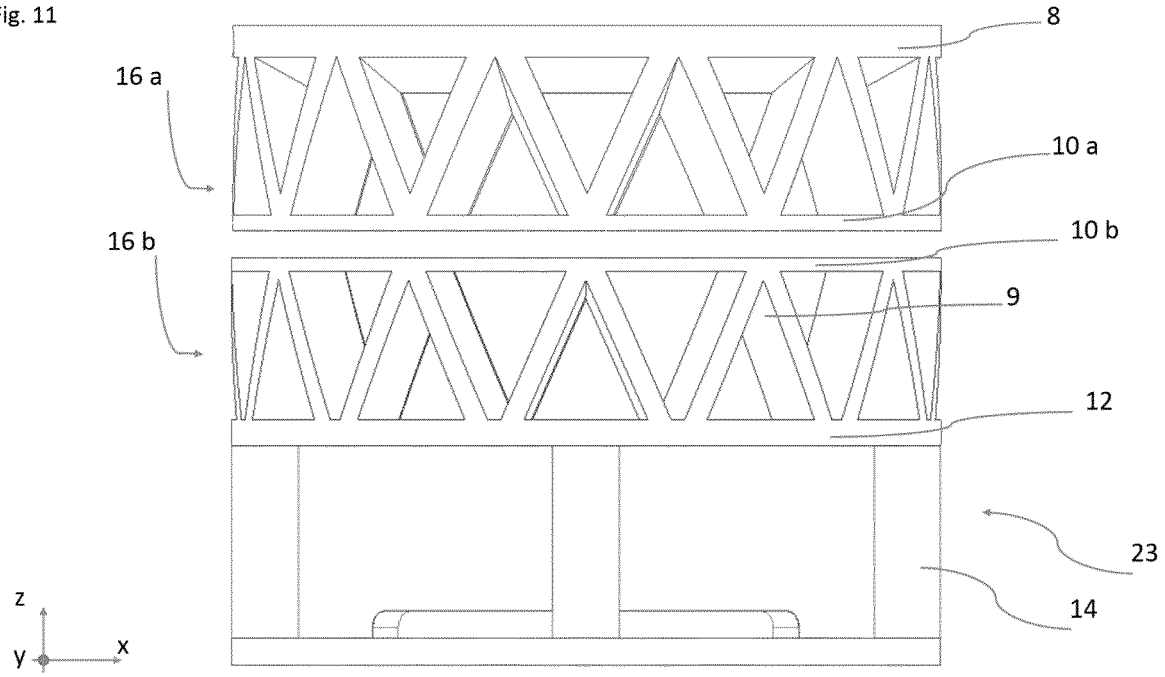
FIG. 11 shows a side view of a horizontally divisible stator. To clarify the divisibility, the stator rings are shown spaced.

FIG. 11 is a side view showing the stator (16) and the support device (23) showing the divisibility of the individual components composed of the upper stator ring (16*a*), the lower stator ring (16*b*) and the support device (23). The separation planes are located in each case in the region of the intermediate rings (10*a*, 10*b*) and between the seal ring (12) and spacers (14) of the support device (23).

Figure 12:
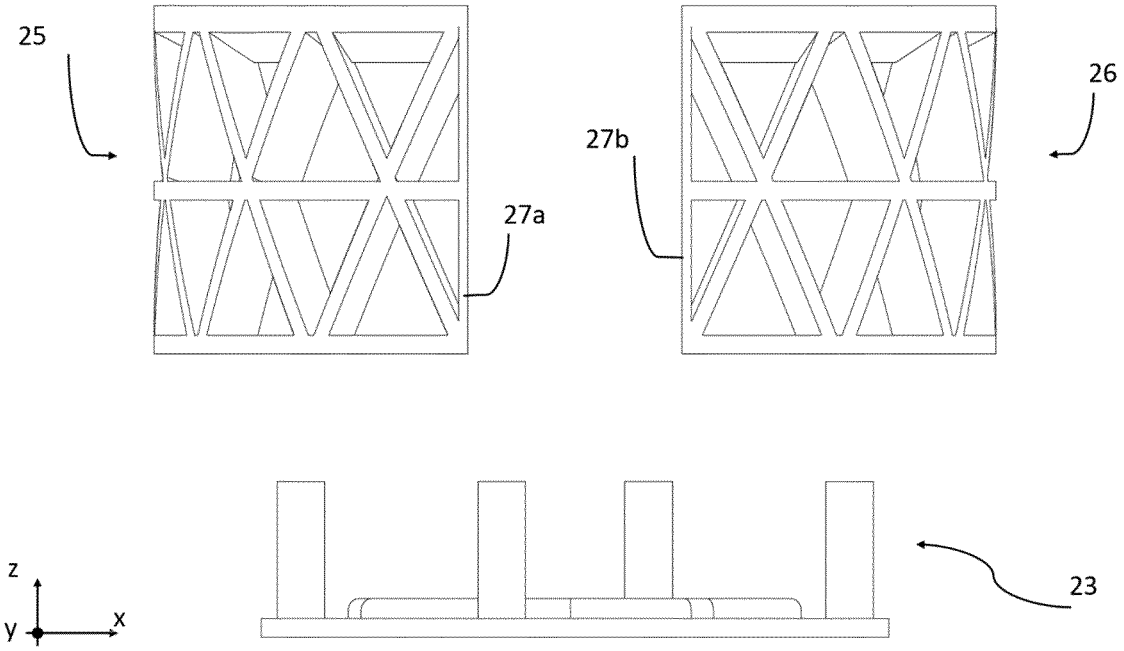
FIG. 12 shows in a side view the vertically divisible stator of FIG. 11, in its individual segments.

The vertically divisible stator (16) of FIG. 11, its two individual parts (25) and (26), as well as the support device (23) are shown in FIG. 12. In this case, the stator is subdivided by vertically arranged divider plates (27*a, b*), which are detachably connected to one another and thus enable a simpler mounting of the stator.

Another alternative embodiment of the stator (16) is disclosed by FIG. 13. In this case, the rectilinear exterior circumferential surface (20) forms the exterior wall of a hollow cylinder.

REFERENCE NUMERALS

1 Plate
2 Rotor vane, long
3 Rotor vane
4 Rotor vane
5 Drive shaft
6 Air outlet opening
7 Air guidance channel
8 Cover ring
9 Stator baffles
10 Intermediate ring
10 *a* Divisible intermediate ring of the upper stator ring
10 *b* Divisible intermediate ring of the lower stator ring
12 Seal ring
13 Bottom surface of the stator
14 Spacer
15 Rotor
16 Stator
16 *a* Stator ring
16 *b* Stator ring
17 Axis of rotation
18 Tank of a flotation cell
19 Inner circumferential surface of the stator
20 Exterior circumferential surface of the stator
21 Bottom edge of the vanes
22 Inner edge of the vanes
23 Support device of the stator
24 Vortex breaker
25 Vertically divided stator part
26 Vertically divided stator part
27 Vertical divider plates
28 Direction of rotation of the rotor
29 Flow direction of the suspension

The invention claimed is:

1. A device for generating gas bubbles in suspensions, which are contained in a tank (18), having a rotation-symmetric stator (16) and a rotation-symmetric rotor (15), which is connected to a hollow drive shaft (5), wherein the stator (16), the rotor (15) and the hollow drive shaft (5) are arranged concentrically about a vertical axis of rotation (17) of the rotor (15) and the drive shaft (5), and the rotor (15) executes a rotational movement about the axis of rotation (17) inside the stator (16), wherein the rotor (15) has, on its upper end, a plate (1), which is oriented perpendicular to the axis of rotation (17) and on which vanes (2, 3, 4) are arranged that are oriented perpendicular to this plate (1) and radially to the axis of rotation (17), wherein the radial extension of the vanes (2, 3, 4) is greatest in the region of the plate (1), the stator (16) is constructed as a cylindrical hollow body that projects axially beyond the rotor (15) on an upper side of the rotor, wherein a casing of the cylindrical hollow body consists of a plurality of strip-shaped, radially oriented baffles (9) and is arranged on a support device, and wherein the hollow body of the stator (16) is shaped in a concave manner at its inner circumferential surface (19) and the inner circumferential surface (19) has the same distance to the outer circumferential surface (20), the support device (23) has a bottom surface (13), a spacer (14) and a vortex breaker (24), the stator (16) is spaced from the bottom surface (13) by the spacer (14) of the vortex breaker (24), a top surface, opposite the bottom surface, of the stator (16) has an opening, which is constructed in such a manner that the rotor (15) can be passed through it and the opening is surrounded by a cover ring (8), which seals the baffles (9) in an axial direction, at least one opening (6) for the intake of air into the suspension is arranged on the hollow drive shaft (5) of the rotor (15), below the plate (1) of the rotor (15), in the region of the vanes (2, 3, 4), wherein the rotor (15) has said vanes (2,3,4), which extend from the plate (1) in an axial direction to varying distances, at least two vanes (3, 4) of the rotor (15), which are arranged in the circumferential direction of the drive shaft (5), have a radial distance r to the axis of rotation (17), a first portion of the baffles (9) of the stator (16) runs at an angle α of 30° to 60° to the axis of rotation and a second portion of the baffles (9) of the stator (16) runs at an angle α' of −30° to −60° to the axis of rotation (17) and the angles α and α' have the same absolute value, and the baffles (9) of the stator (16) are connected to each other.

2. The device according to claim 1, wherein an exterior contour of the vanes (2, 3, 4) continually decreases, in a straight-line or convex-curved manner, in said axial direction as the distance from the plate (1) increases.

3. The device according to claim 2, wherein the exterior contour of the vanes (2, 3, 4) continually decreases in a straight-line or convex-curved manner in the axial direction as the distance from the plate (1) increases.

4. The device according to claim 1, wherein the vanes comprise a first, a second, and a third partial quantity, wherein the second and third partial quantities of the vanes (3, 4) have a smaller extension in the axial direction than the first partial quantity of the vanes (2), which has the maximum dimension in the axial direction.

5. The device according to claim 4, wherein the second and third partial quantities of the vanes (3, 4) are constructed having equal or variable lengths in the axial direction.

6. The device according to claim 4, wherein the second and third partial quantities of the vanes (3, 4) are connected in a radial orientation to the drive shaft (5).

7. The device according to claim 4, wherein inside edges (22) of the second and third partial quantities of the vanes (3, 4) are constructed in a tapering manner, or in a manner so as to taper to a point, toward the axis of rotation (17).

8. The device according to claim 4, wherein bottom edges (21) of the second and third partial quantities of the vanes (3, 4) are inclined toward the air inlet openings (6) and thereby form an angle $\gamma$ between 0° and 60° relative to the horizontal.

9. The device according to claim 4, wherein air guidance devices (7) are arranged in the region of the air inlet openings (6) and are inclined toward the bottom (13) and thereby form an angle $\varepsilon$ between 20° and 60° relative to the axis of rotation.

10. The device according to claim 4, wherein a first partial quantity of the baffles (9) and a second partial quantity of the baffles (9) are of the same size and both partial quantities constitute a total quantity of baffles (9).

11. The device according to claim 1, wherein the distance r corresponds to between 30% and 70% of the radius R of the rotation-symmetric plate (1).

12. The device according to claim 1, wherein the hollow body of the stators (16) is shaped in a linear or convex manner at its outer circumferential surface (20).

13. The device according to claim 1, wherein the stator (16) consists of at least one stator ring (16 *a*, 16 *b*), which consists of the cover ring (8) and an intermediate ring (10) and the baffles (9) connecting the cover ring (8) and the intermediate ring (10).

14. The device according to claim 13, wherein intermediate rings (10*a, b*) or vertical divider plates (27*a*, 27*b*) are detachably connected to each other.

15. The device according to claim 1, wherein cover ring (8) of the stator (16) is oriented horizontally or inclined toward the rotor (15) and forms an angle $\beta$ of between 30° and 90° to the axis of rotation (17) of the rotor (15).

16. The device according to claim 1, wherein the rotor (15) and the stator (16) are fully or partially provided with a wear-protection layer.

17. The device according to claim 16, wherein the wear-protection layer is a plastic coating or is constructed as a modification of a microstructure of a material of which the rotor (15) and stator (16) are made.

18. A method for generating bubbles comprising operating the device for generating gas bubbles according to claim 1 in a tank (18) of a flotation cell, having a rotor (15) and a stator (16) according to claim 1, wherein the rotor (15) and the stator (16) are arranged in the bottom third of the tank of the flotation cell.

* * * * *